US006174251B1

(12) United States Patent
Lemote

(10) Patent No.: US 6,174,251 B1
(45) Date of Patent: Jan. 16, 2001

(54) ARROW FOR DISPERSING OLFACTANT

(76) Inventor: David R. Lemote, 33 Chestnut St., Milford, MA (US) 01757

( * ) Notice: Under 35 U.S.C. 154(b), the term of this patent shall be extended for 0 days.

(21) Appl. No.: 09/484,977

(22) Filed: Jan. 18, 2000

Related U.S. Application Data

(60) Provisional application No. 60/131,176, filed on Apr. 26, 1999.

(51) Int. Cl.[7] ..... F42B 6/04
(52) U.S. Cl. ..... 473/581; 239/145
(58) Field of Search ..... 239/145, 289; 473/578, 581

(56) References Cited

U.S. PATENT DOCUMENTS 3,565,435 * 2/1971 Bear ..... 473/581
5,746,019 * 5/1998 Fisher ..... 239/145 X
5,836,842 * 11/1998 McLearan ..... 473/581
6,059,677 * 5/2000 Breshears ..... 473/581

* cited by examiner

*Primary Examiner*—John A. Ricci
(74) *Attorney, Agent, or Firm*—David J. Cole

(57) ABSTRACT

An arrow (10) intended for dispersing olfactant (for example, for use in deer hunting) and comprising an elongate body (12) having an internal cavity (14), this cavity (14) having a container portion (18) to accommodate a frangible liquid container (20). A container rupturing device (24) is disposed within the cavity (14) adjacent the container portion (18), this device (24) being such that the arrow, with a container (20) on board, can be launched from a bow without rupturing the container (20), but that upon the arrow (10) striking a target, the device (24) will rupture the container. A wick (40) is disposed within the cavity (14) adjacent the container portion (18), this wick (40) being capable of absorbing the liquid released from the rupture of the container (20). The body (12) has apertures (42) extending from the cavity (14) to the exterior of the body (12) adjacent the wick (40), so that gas produced by evaporation of liquid absorbed on the wick (40) can diffuse out of the arrow.

10 Claims, 1 Drawing Sheet

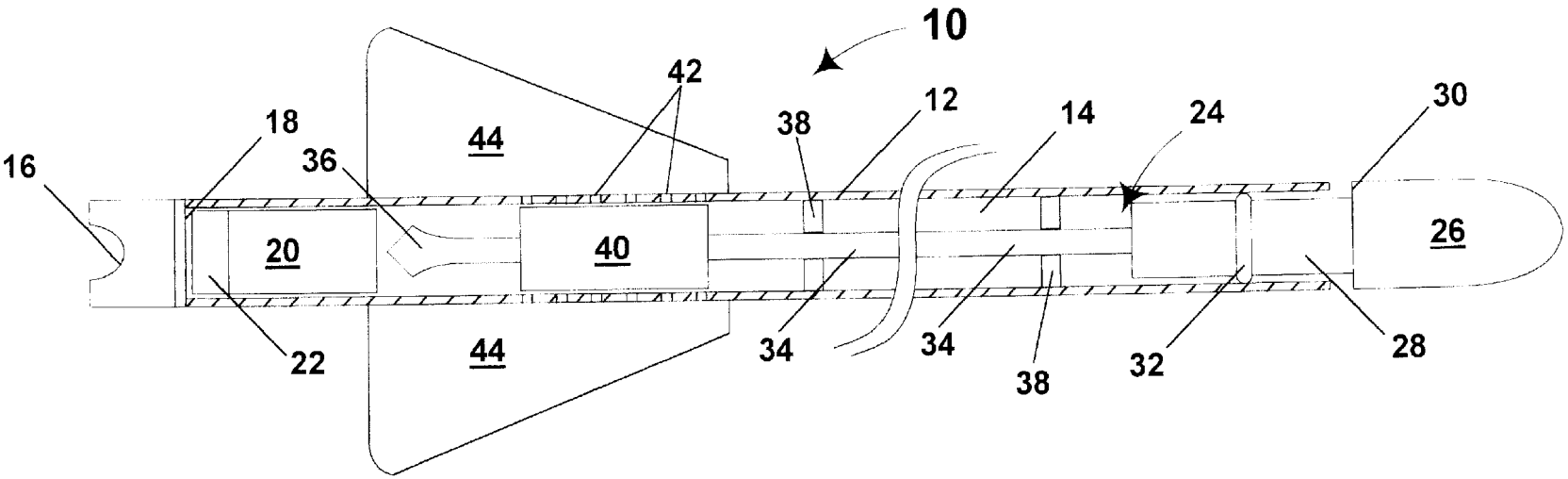
Figure

ARROW FOR DISPERSING OLFACTANT

REFERENCE TO RELATED APPLICATION

This application claims priority from U.S. application Ser. No. 60/131,176, filed Apr. 26, 1999.

BACKGROUND OF THE INVENTION

This invention relates to an arrow for dispersing olfactant. More specifically, this invention relates to an arrow which can be fired from a bow without dispersing olfactant contained within the arrow, but which disperses the olfactant when it reaches its target.

Many people hunt game, especially deer, using bows and arrows, and many states have special bow hunting seasons, when hunting is permitted using bows and arrows but not firearms. Obviously the range of a bow is much shorter than that of a firearm, and in practice, to have a good chance of inflicting a fatal wound with an arrow, a hunter needs to be within about 25 yards from a deer. Given deer's keen senses of smell and sight, including keen night vision, in practice the bow hunter must remain concealed within a hide in a tree until the deer approaches. To attract deer close to the hide, it is normal to spread an olfactant (usually called "deer scent" and hereinafter sometimes abbreviated simply as "scent") at the location at which the concealed hunter has a good shot. Unfortunately, spreading the scent is not without problems. Deer hunting is usually effected around dawn, a time of day at which deer are most active. Thus, the hunter needs to spread the scent while it is still dark in order that he can return to the hide and allow a sufficient time to pass for the deer to follow the scent to the target area. Since deer hunting is typically carried out in a forest, where tree roots are everywhere, it is easy for the hunter to trip over roots or other obstacles while spreading the scent, and thus either injure himself or at least make enough noise to frighten the timid deer away for a substantial period.

It has already been realized by hunters that, rather than the hunter descending to the ground and spreading the scent manually, it would be advantageous if the hunter could remain within the hide and spread the scent by firing an arrow into the target area. However, previous attempts to disperse scent by means of an arrow have suffered from serious problems. Typically, a rag or other absorbent for the scent has simply been tied to the arrow, and the scent manually applied to the absorbent. It is not easy for a hunter to apply the scent to the absorbent without putting scent on his hands. Also, when such an absorbent-carrying arrow is fired, much of the scent is dispersed from the absorbent under the sudden acceleration applied by the bow, and part of this dispersed scent may end up on the bow and/or the hunter. Further dispersion of the scent takes place during the rapid flight of the arrow through the air, and if there is any breeze, the scent dispersed into the air may be carried a considerable distance, with the result that deer, detected the scent thus scattered, may be attracted to a location well out of arrow range of the bide. Also, it is extremely undesirable for the hunter to get scent on himself or his clothes or equipment, since upon leaving the hide the unfortunate hunter is liable to be tracked by deer noticing his scent, and the deer may attack the hunter when the deer discovers that the hunter is in fact not the potential mate or potential rival that the deer assumed from the hunter's smell.

Thus, there is a need for an arrow which can contain scent and can be fired from a bow without dispersion of this scent, but which releases the scent in a controlled manner when the arrow strikes its target. This invention provides such an, arrow.

SUMMARY OF THE INVENTION

Accordingly, this invention provides an arrow comprising: an elongate body having walls defining an internal cavity therein, this cavity having a container portion arranged to accommodate a frangible container for a liquid; a container rupturing device disposed within the cavity adjacent the container portion thereof, the container rupturing device being such that the arrow, with a container arranged in the container portion of the cavity, can be launched from a bow without the container rupturing device rupturing the container, but that upon the arrow striking a target, the container rupturing device will rupture the container, thereby releasing liquid therefrom; and liquid absorption means disposed within the cavity adjacent the container portion thereof, the liquid absorption means being capable of absorbing liquid released from the container upon rupture thereof by the container rupturing device. The body of the arrow has walls defining at least one aperture extending from the cavity to the exterior of the body adjacent the liquid absorption means, so that gas produced by evaporation of liquid absorbed on the liquid absorption means can diffuse via the at least one aperture out of the arrow.

This invention also provides a method of dispersing a liquid to a locus remote from an observer. This method comprises providing to the observer an arrow having an internal cavity, and a frangible container disposed within the internal cavity and containing a liquid, the arrow further comprising a container rupturing device disposed adjacent the container, the container rupturing device being such that the arrow, with a container therein, can be launched from a bow without the container rupturing device rupturing the container, but that upon the arrow striking a target, the container rupturing device will rupture the container, thereby releasing the liquid from the container; and firing the arrow from a bow carried by the observer, thereby causing the arrow to travel to the remote locus, whereupon, upon contact of the arrow with the remote locus, the container rupturing device will rupture the container, thereby causing the liquid to be dispersed at the remote locus.

BRIEF DESCRIPTION OF THE DRAWING

The sole FIGURE of the accompanying drawings shows a side elevation of a preferred arrow of the invention, with part of the body of the arrow removed to show the internal construction. The FIGURE is not strictly to scale; specifically, the diameters of various components of the arrow has been exaggerated relative to the lengths thereof for ease of illustration.

DETAILED DESCRIPTION OF THE INVENTION

The arrow (generally designated 10) shown in the FIGURE comprises an elongate body 12 having the form of a hollow cylinder with an internal cylindrical cavity 14. The body 12 is open at its forward end (to the right in the FIGURE) but is closed at its rearward end and provided with a conventional nock 16 to accommodate a bow string. A "container portion" 18, namely the rearward portion of the cavity 14, accommodates a cylindrical scent container 20, which fits closely but slideably within the cavity 14. The container 20 is provided with a removable stopper 22, which can be removed to fill the container with scent (this is normally done by the hunter some considerable time before hunting begins, so that any trace of scent which the hunter receives on to his hands while filling the container has time to disperse before the hunt). The base or forward end of the container is made thinner and more frangible than the rest of the container, for reasons explained below.

The arrow 10 further comprises a container rupturing device (generally designated 24) formed in several sections, as follows:

(a) a cylindroconical head section 26, which forms the point of the arrow;

(b) a cylindrical body section 28 integral with but of smaller diameter than the tip section 26, so that a shoulder 30 is formed at the junction of the two sections;

(c) a compression member 32 in the form of a toroidal ring accommodated within a groove (not shown) adjacent the middle of the body section 28;

(d) an elongate cylindrical rod section 34 extending rearwardly from the body section 28; the rearmost part of the rod section 34 flattened radially and machined to form (e) a sharpened tip section 36 adjacent the frangible base of the container 20.

Spacers 38, having the form of annular prisms, are provided at intervals along the rod section 34 to keep the rod section 34 located axially within the cavity 14 of the body 12.

A liquid absorption means or wick 40, formed of a fibrous material surrounds the rod section immediately forward of the tip section 36. Three rows (only two of which are visible in the FIGURE) of small apertures 42 extend radially through the sidewall of the body 12 adjacent the wick 40, the outward ends of these apertures 42 emerging in the spaces between three conventional vanes 44 which are disposed at intervals of 120° around the body 12 adjacent the wick 40.

The arrow 10 is used in the following manner. The container 20 is filled with scent as previously described, and placed in position in the container portion 18 of the cavity 14, conveniently by holding the body 12 upright and simply dropping the container down the cavity 14. The container rupturing device 24 is then manually pushed into the cavity 14 to the position shown in the FIGURE, so that the point 36 does not rupture the container 20. It may be desirable to provide a marking on the body section 28 of the container rupturing device 24 to indicate the correct position of the container rupturing device relative to the body 12, the hunter aligning this marking with the forward end of the body 12 to position the container rupturing device 24 at its correct position. The arrow can now be fired from any conventional bow; the compression member 32 coacts with the internal surface of the body 12 with sufficient force to allow the allow to be fired without the container rupturing device 24 sliding relative to the body 12, so that the container 20 remains unruptured. However, when the arrow strikes its target, the abrupt deceleration of the container rupturing device 24 caused by the impact of its head section 26 on the target causes the body 12 and the container 20 to slide forwardly relative to the container rupturing device 24, thus causing the point 36 to penetrate the frangible base of the container 20 and release the scent contained therein. This scent is immediately absorbed by the wick 40, and thereafter the scent gradually evaporates from the wick, forming a vapor which diffuses out through the apertures 42 and attracts deer to the target for a substantial period.

From the foregoing, it will be seen that this invention provides an arrow which can deliver scent to a target without spreading scent on the hunter or his equipment and without dispersing scent to sites remote from the target. Accordingly, the arrow of this invention greatly simplifies the use of deep scent by bow-and-arrow hunters, and may also be useful to such hunters seeking other game.

It will be apparent to those skilled in the art that numerous changes and variations can be made in the specific embodiments of the invention described above without departing from the scope of the present invention. For example, the container rupturing device need not be a simple point as shown in the FIGURE; various forms of mechanical spring loaded device might be used to rupture the container. Accordingly, the foregoing description is to be construed in an illustrative and not in a limitative sense, the scope of the invention being defined solely by the appended claims.

What I claim is:

1. An arrow comprising:

an elongate body having walls defining an internal cavity therein, this cavity having a container portion arranged to accommodate a frangible container for a liquid;

a container rupturing device disposed within the cavity adjacent the container portion thereof, the container rupturing device being such that the arrow, with a container arranged in the container portion of the cavity, can be launched from a bow without the container rupturing device rupturing the container, but that upon the arrow striking a target, the container rupturing device will rupture the container, thereby releasing liquid therefrom; and liquid absorption means disposed within the cavity adjacent the container portion thereof, the liquid absorption means being capable of absorbing liquid released from the container upon rupture thereof by the container rupturing device, the body having walls defining at least one aperture extending from the cavity to the exterior of the body adjacent the liquid absorption means, so that gas produced by evaporation of liquid absorbed on the liquid absorption means can diffuse via the at least one aperture out of the arrow.

2. An arrow according to claim 1 wherein the body has substantially the form of a hollow cylinder open at one end, with the hollow interior of the cylinder forming the internal cavity and extending substantially the entire length of the body, the container portion of the cavity being the portion remote from the open end of the cylinder.

3. An arrow according to claim 1 wherein the container rupturing device has a point directed towards the container portion of the cavity, this point being movable relative to the body so that upon the arrow striking a target, the point will move toward and rupture the container.

4. An arrow according to claim 3 wherein the liquid absorption means comprises a body of fibrous material arranged adjacent the point.

5. An arrow according to claim 3 wherein the container rupturing device extends beyond the forward end of the body so that the forward end of the container rupturing device forms the point of the arrow, the container rupturing device being a compression fit within the body so that the arrow can be launched from a bow without substantial relative movement between the body and the container rupturing device, but upon the arrow striking a target, the abrupt deceleration of the container rupturing device will cause the body to move forwardly relative to the container rupturing device, so that the point of the container rupturing device will rupture the container.

6. An arrow according to claim 5 wherein the container rupturing device is provided with a least one spacer arranged to coact with the internal surface of the body so as to maintain the container rupturing device centrally located within the body.

7. An arrow according to claim 1 wherein the body carries, adjacent its rearward end, a plurality of vanes extending radially outwardly from the body, and the at least one aperture is located between the vanes.

8. A method of dispersing a liquid to a locus remote from an observer, the method comprising:

providing to the observer an arrow having an internal cavity, and a frangible container disposed within the internal cavity and containing a liquid, the arrow further comprising a container rupturing device disposed adjacent the container, the container rupturing device being such that the arrow, with a container therein, can be launched from a bow without the container rupturing device rupturing the container, but that upon the arrow striking a target, the container rupturing device will rupture the container, thereby releasing the liquid from the container; and firing the arrow from a bow carried by the observer, thereby causing the arrow to travel to the remote locus, whereupon, upon contact of the arrow with the remote locus, the container rupturing device will rupture the container, thereby causing the liquid to be dispersed at the remote locus.

9. A method according to claim 8 wherein the arrow further comprises liquid absorption means disposed adjacent the container, the liquid absorption means absorbing liquid released from the container upon rupture thereof by the container rupturing device.

10. A method according to claim 9 wherein the arrow has walls defining at least one aperture extending from adjacent the liquid absorption means to the exterior of the body, so that gas produced by evaporation of liquid absorbed on the liquid absorption means diffuses via the at least one aperture out of the arrow.

* * * * *